United States Patent [19]

Johnson

[11] 4,384,557

[45] May 24, 1983

[54] APPARATUS FOR DRAINING LIQUID FROM AN ENGINE

[75] Inventor: Duane H. Johnson, Dunlap, Ill.

[73] Assignee: Caterpillar Tractor Co., Peoria, Ill.

[21] Appl. No.: 278,502

[22] PCT Filed: Mar. 18, 1981

[86] PCT No.: PCT/US81/00339

§ 371 Date: Mar. 18, 1981

§ 102(e) Date: Mar. 18, 1981

[87] PCT Pub. No.: WO82/03251

PCT Pub. Date: Sep. 30, 1982

[51] Int. Cl.[3] ..... F02B 77/00

[52] U.S. Cl. ..... 123/198 D; 123/195 C; 123/468; 285/14

[58] Field of Search ..... 123/198 D, 468, 469, 123/470, 195 C; 285/13, 14, 93

[56] References Cited

U.S. PATENT DOCUMENTS

| | | | |
|---|---|---|---|
| 1,664,125 | 3/1928 | Lowrey . | |
| 2,313,323 | 3/1943 | Cowles | 285/87 |
| 2,326,171 | 8/1943 | Reggio | 123/139 |
| 2,463,707 | 3/1949 | Matousek | 285/166 |
| 2,548,904 | 4/1951 | Neal et al. | 60/44 |
| 3,125,078 | 3/1964 | Reiners | 123/32 |
| 3,194,221 | 7/1965 | Dinger et al. | 123/32 |
| 3,390,830 | 7/1968 | Kahane | 285/14 |
| 3,402,703 | 9/1968 | Dickerson et al. | 123/32 |
| 3,489,435 | 1/1970 | Weber et al. | 285/13 |
| 3,612,577 | 10/1971 | Pope | 285/14 |
| 3,783,842 | 1/1974 | Kuhn et al. | 123/195 C |
| 3,845,748 | 11/1974 | Eisenberg | 123/468 |
| 3,929,109 | 12/1975 | Chamberlain | 123/468 |
| 4,149,568 | 4/1979 | Kuntz et al. | 138/114 |
| 4,168,689 | 9/1979 | Pau | 123/468 |
| 4,185,462 | 1/1980 | Morse et al. | 285/13 |

*Primary Examiner*—Ira S. Lazarus

*Attorney, Agent, or Firm*—Phillips, Moore, Lempio & Finley

[57] ABSTRACT

Fittings with internal drain passages leading to the outside through an exterior orifice are normally used in high pressure fluid systems where fluid must be transferred through a wall and leakage on at least one side of the wall cannot be tolerated. Such fittings are used, for example, in compression ignition engines where the fuel injectors are located inside of the valve cover. Any leakage drains from the exterior orifice of the fitting down the outside of the engine. On some installations the side of the engine on which these fittings are mounted must be located out of sight of the operator and the operator is unable to observe if any leakage is occurring. The present invention overcomes this problem by providing a fitting (12) that drains into a drain passage (64) that is located within the engine wall (7, 11). The drain passage (64) in the engine wall (7, 11) is routed within the engine (4) to the most convenient drain point (80) for monitoring.

14 Claims, 3 Drawing Figures

APPARATUS FOR DRAINING LIQUID FROM AN ENGINE

DESCRIPTION

1. Technical Field

This invention relates generally to apparatus for draining liquids from engines and more particularly to connector fittings and conduits that permit high pressure fuel lines to pass through engine walls.

2. BACKGROUND ART

In engines that have fuel injectors that are located inside of the valve covers, the high pressure fuel lines to the injectors must pass through either a wall of the engine or the valve cover. In most cases special fittings are used which seat in a bore through the wall so that the lubricating oil is sealed within the engine and does not leak out and so that the diesel fuel does not leak into the engine and contaminate the lubricating oil.

Prior work in this field of technology includes U.S. Pat. No. 3,402,703 entitled "Fuel Connection to Cylinder Head" issued to Dickerson et al. on Sept. 24, 1968 and U.S. Pat. No. 3,489,435 entitled "Fuel Line Fitting" issued to Weber et al. on Jan. 13, 1970 and assigned to the assignee of the present invention. These devices prevent any leakage of diesel fuel in the fitting from contaminating the lubricating oil in the engine by incorporating a drain passage within the body of the fitting. Any internal leakage within the fitting flows through the drain passage, out to the atmosphere, and down the side of the engine. A further feature of these devices is that any leakage in the fittings is signals to the operator by the flow of diesel fuel on the side of the engine.

Further work in the field of couplings and fuel fittings includes U.S. Pat. No. 1,664,125 entitled "Hose Coupling" issued to Lowrey on Mar. 27, 1928; U.S. Pat. No. 2,313,323 entitled "Injector Tube Coupling Means" issued to Cowles on Mar. 9, 1943; U.S. Pat. No. 2,326,171 entitled "Fuel Injection Device" issued to Reggio on Aug. 10, 1943; U.S. Pat. No. 2,463,707 entitled "Pipe Coupling" issued to Matousek on Mar. 8, 1949; U.S. Pat. No. 2,548,904 entitled "Jet Engine Fuel Nozzle Holder and Mounting" issued to Neal et al. on Apr. 17, 1951; and U.S. Pat. No. 3,125,078 entitled "Fuel Supply System" issued to Reiners on Mar. 17, 1964.

One problem with fittings that incorporate a drain passage leading to the outside of the fitting is that in some installations the side of the engine on which the fittings are located must be located against a wall or bulkhead. Thus, any leakage from the drain passage of a fitting down the side of the engine cannot be observed by the operator.

A further problem with providing a drain passage to the atmosphere through a fuel line fitting is that the leakage may run down the respective inlet fuel line instead of the engine wall. This could possibly mislead the operator into believing that the leakage is from the fuel injection pump.

The present invention is directed to overcoming one or more of the problems set forth above.

DISCLOSURE OF THE INVENTION

In one aspect of the present invention an apparatus for draining liquid from an engine, preferably for a fuel line of the engine, is contemplated that includes a valve cover base having a bore therethrough and drain passage connected to the bore; a valve cover connected to said valve cover base and defining therewith a drain channel having a remote drain point and communicating with the drain passage; and a connector fitting having a drain port therein and being received in said bore such that liquid can be communicatfed from the drain port to the remote drain point through the drain passage and drain channel.

The present invention solves the problem of having the internal leakage from a fuel line fitting drain at an inconvenient location on the engine by providing an improved fuel line fitting that drains into a drain passage located within the engine wall. This drain passage in the engine wall is routed to the most convenient location for monitoring.

One feature that is obtained by running the drain passage in the engine wall and by locating the drain point at a location remote from the fitting is that leakage from the fitting cannot be mistaken for leakage from the fuel pump or the fuel lines.

Other aspects, objects and advantages of this invention can be obtained from a study of the drawings, the disclosure and the appended claims.

BEST MODE FOR CARRYING OUT THE INVENTION

Figure 1:
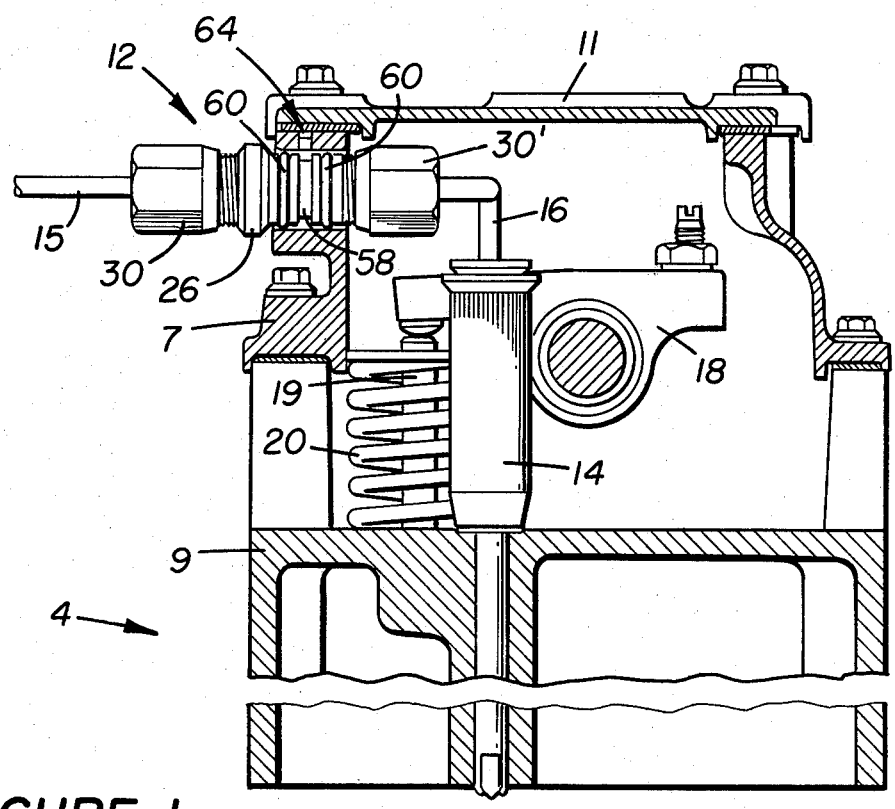
FIG. 1 is a side elevational view, broken away and in section, of the interior of a valve compartment of a compression ignition engine and illustrating an embodiment of the present invention.

Referring to the figures, FIG. 1 illustrates the interior of a valve compartment on a compression ignition engine 4. The valve compartment includes a valve cover base 7 that is rigidly mounted on an engine head 9. The valve cover base is sealed by a valve cover 11 and gasket of conventional construction. Fuel from the fuel pumping system of the engine is conducted through the wall of the valve cover base 7 by a fuel line fitting 12 according to the present invention. The fuel enters the fitting from an inlet fuel line 15 and is directed into an outlet fuel line 16 which is connected to a standard fuel injector 14. The interior of the valve compartment also includes a plurality of rocker arms 18 which actuate a corresponding plurality of valves 19 and valve springs 20 in a conventional manner.

Figure 2:
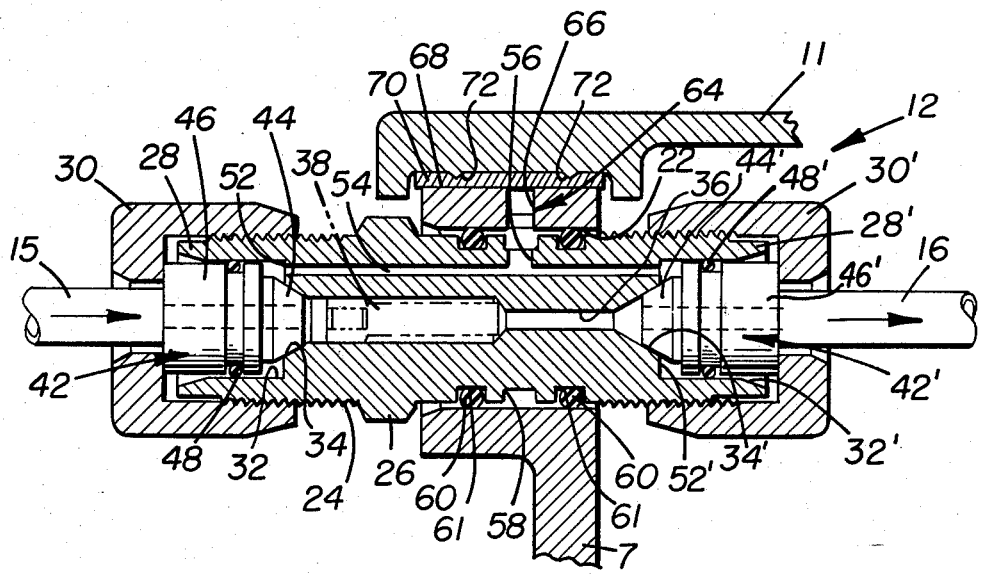
FIG. 2 is a side elevational and enlarged view, broken away and in section, of the fuel line fitting of FIG. 1.

Referring to FIG. 2, the fuel line fitting 12 is received in a bore 22 formed through a support member, such as the valve cover base 7 or a convenient wall of the engine 4. The fitting includes an elongate body 24 having two free ends 28, 28' that are each threaded to receive nuts 30 and 30', respectively. The body further has a generally cylindrical sidewall and mounting collar or nut portion 26 for engaging a wrench to tighten the nuts 30, 30' onto the threaded free ends 28, 28'. The free ends each contain a connecting chamber 32, 32' that is conically counter-bored to form an inclined end wall 34, 34'. The body 24 of the fuel line fitting further includes a central, axial, main fuel passage 36 that connects the centers of the end walls 34, 34'. All of the fuel passing through the fitting 12 to the fuel injector 14 flows through the main fuel passage. To remove any contaminates and impurities in the fuel, the main fuel passage contains a filter 38 of conventional construction.

The high pressure inlet fuel line 15, FIG. 2, is secured to the body 24 of the fuel fitting using a connector 42 of conventional construction. The connector includes a conical end 44 that is either brazed to the end of the fuel line 15 or formed by upsetting the end of the fuel line 15. The end 44 is shaped to engage the end wall 34 of the connecting chamber 32. Behind the conical end is a ferrule 46 that is engaged by the nut 30. When the nut 30 is threaded onto the free end 28 of the body 24, the nut forces the ferrule 46 into the connecting chamber 32 and the conical end 44 frictionally engages the inclined end wall 34. Leakage around the connector 42 is eliminated by an O-ring seal 48. The outlet fuel line 16 is secured to the body 24 of the fuel fitting 12 using a connector 42' having a conical end 44' in engagement with the inclined end wall 34' and which is constructed and functions in the same manner as the connector 42 described above.

Referring to FIG. 2, the connectors 42, 42' are sealed against the end walls 34, 34' by abutting engagement so that the fuel in the inlet fuel line 15 passes into the main fuel passage 36, through the filter 38, into the connector 42', through the outlet fuel line 16 and into the fuel injector 14. Any leakage between the abutting surfaces of the conical ends 44, 44' of the connectors 42, 42' and the end walls 34, 34' collects in an annular area 52, 52' in the respective connecting chambers 32, 32'. Leakage to the outside from around the connectors 42, 42' is stopped by the O-rings 48, 48'. The leakage fuel which collects in the annular area 52 is drained from the fitting through an axial drain passage 54 in the body 24 of the fitting 12. The axial drain passage is parallel and spaced apart from the main fuel passage 36. The axial drain passage communicates with the annular area in each connecting chamber and with a radial connecting passage or drain port 56. The connecting passage or drain port drains the leakage into a circumferential medial groove 58 in the sidewall of the body 24 of the fitting. The medial groove extends completely around the body and is of sufficient depth to accommodate all of the flow from the connecting passage 56. The leakage draining into the medial groove 58 is prevented from flowing outward along the outside of the body 24 of the fitting by two O-rings 60 that are received in the two outer grooves 61.

Figure 3:
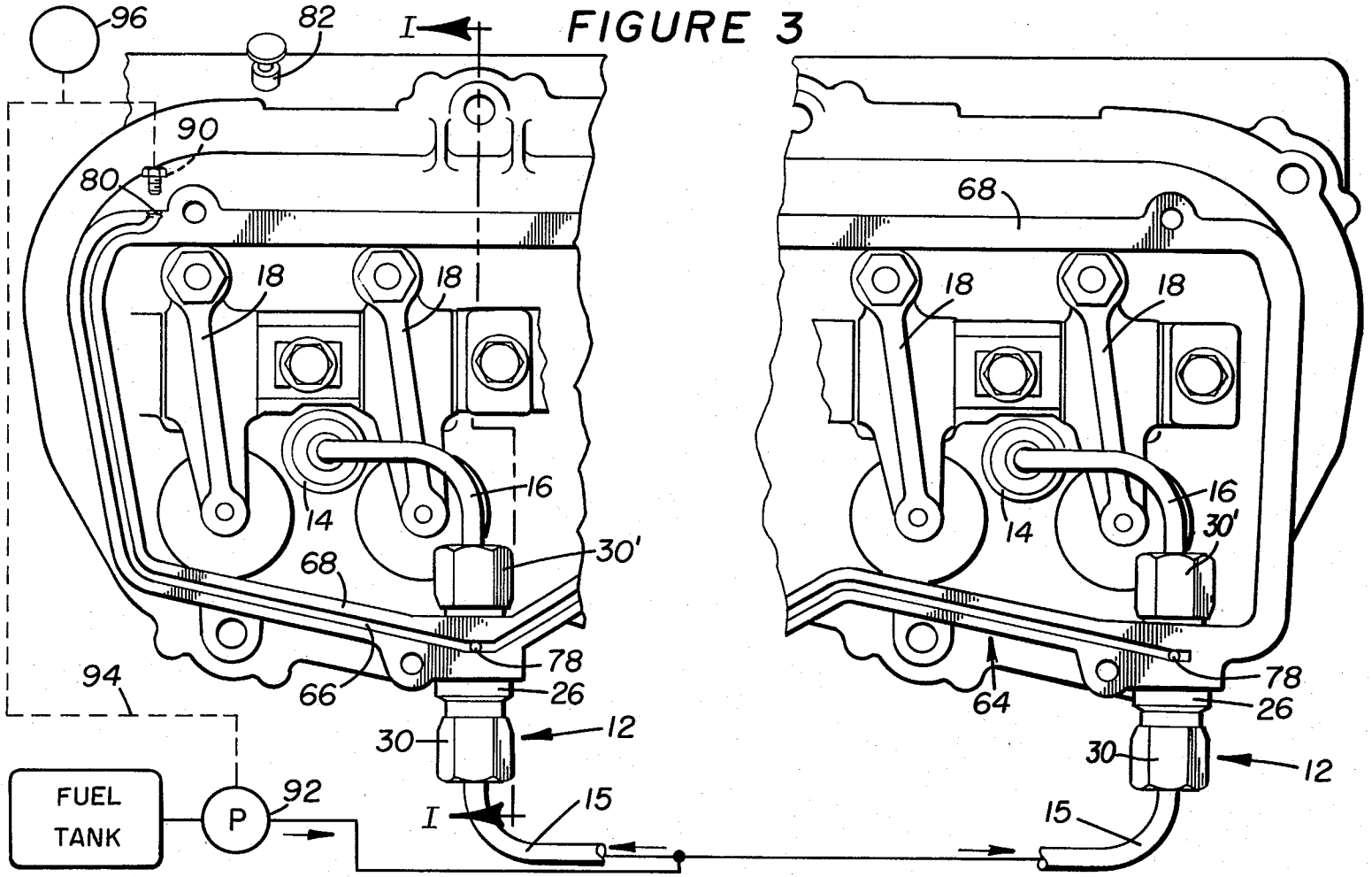
FIG. 3 is a top plan view, broken away, of the interior of the valve cover base of FIG. 1 and illustrating a common drain passage that communicates with all of the fuel line fittings in the engine according to the present invention.

Referring to FIGS. 1, 2 and 3, the medial groove 58 on each fuel line fitting 12 drains into a common engine drain passage 64 that is functionally located within a wall of the engine. The engine drain passage is formed by a drain channel 66 that is formed in the mating surface 68, FIG. 3, of the valve cover base 7. The drain passage is also formed by a valve cover gasket 70 and two ridges 72, FIG. 2, in the mating surface of the valve cover 11. Each fuel line fitting 12 in the engine communicates with the common drain channel 66 through an associated engine drain connecting passage 78 located in the bottom of the drain channel 66.

Referring to FIG. 3, any leakage from a fitting 12 flows along the common drain channel 66 of the valve cover base in the drain passage 64 to a convenient point for observation by the operator of the engine. In the preferred embodiment the drain passage 64 terminates at a drain point 80 that is near the engine oil dipstick 82. The drain point can be a hole in the valve cover base or can be a receptacle for a hose leading to a collecting container (not shown). Thus, when the operator performs the daily routine maintenance on the engine, any leakage from the fuel line fittings 12 can be observed at the drain point 80.

FIG. 3 also illustrates an alternative embodiment of the present invention wherein the drain point 80 is threaded to receive a fuel pump fitting 90. The fitting is connected by a suitable conduit 94 to an alarm 96 and/or a fuel transfer pump 92 of the engine. The alarm may, for example, be an electronic sensor for detecting fuel in the conduit 94 and signaling the operator of the leakage. If the fuel transfer pump 92 is connected to the conduit 94, with or without the alarm 96, the fuel transfer pump will draw any leakage through the engine drain passage 64 and insert this leakage back into the inlet fuel line 15, FIG. 1.

INDUSTRIAL APPLICABILITY

The fuel line fitting 12, drain connecting passage 78, and common drain channel 66 described herein can be used in any high pressure fluid system where fluid must be transferred through a wall or bulkhead and leakage on at least one side of the wall cannot be tolerated. One specific application of such an apparatus is in the fuel line of a conventional compression ignition or diesel engine. The apparatus can be used on any sized engine having any number of cylinders. Moreover, the fittings described herein can be used to supply either one cylinder or a plurality of cylinders.

The fuel line fitting 12 is installed in the wall of an engine by first routing the inlet and outlet fuel lines 15, 16 to the bore 22 and installing the connectors 42, 42' on the ends thereof. In the embodiment described herein the wall of the engine is the valve cover base 7. The body 24 of the fitting is next inserted into the bore 22 with the O-rings 60 in place and is secured to the base 7 with a clamp (not shown) that engages the mounting collar 26. The fuel lines 15, 16 are secured in place by tightening the nuts 30, 30' which engage the threads on the free ends of the body 24. The nuts are tightened until the conical ends 44, 44' of the fuel line connectors abut against the conical end walls 34, 34' of the connecting chambers 32, 32' and two fluid tight seals are formed.

In operation the fuel enters the fitting 12, FIG. 2, from the inlet fuel line 15. The fuel passes through the connector 42 and enters the main fuel passage 36. The fuel is directed through the filter 38 and thereafter passes into the outlet connector 42'. The fuel leaves the fitting through the outlet fuel line 16.

If leakage occurs between the conical end wall 34 and the conical end 44 of the connector 42, the fuel that leaks collects in the annular area 52. The O-ring 48 prevents the leakage from passing around the outside of the ferrule 46. The fuel that collects in the annular area 52 drains from the fitting through the elongate body 24 via the axial drain passage 54, the radial connecting passage 56, and the medial groove 58.

Referring to FIG. 3, each fitting 12 in the engine 4 communicates through an engine drain connecting passage 78 to the common drain channel 66 in the mating surface 68 of the valve cover base 7. Any leakage from any of the fittings flow into the drain channel 66 and is directed to the drain point 80. In the preferred embodiment the drain point 80 is an orifice in the side of the engine. If any of the fittings 12 do leak, then the leakage flows to the drain point 80 and drains down the side of the engine and is easily observed by the operator when the lubricating oil level is checked with the dipstick.

In the alternative embodiment illustrated in FIG. 3 the fuel pump fitting 90 is installed and any leakage is directed to the fuel leakage alarm 96 and/or to the suction side of the fuel transfer pump 92. If the leakage is directed to the suction side of the fuel transfer pump 92, the leakage is thereafter directed back into the inlet fuel lines 15. In addition, the fuel transfer pump maintains a slight vacuum in both the common drain channel 66 the drain connecting passage 78 of the valve cover base 7, and the drain passags 58, 56, 54 within each fuel line fitting 12 so that the flow of fuel that has internally leaked in the fitting is induced.

If leakage is observed at the drain point 80, the operator then removes the valve cover 11 and the source of the leakage can be observed without difficulty because the individual drain connecting passages 78 are exposed. Leakage is stopped either by tightening the nuts 30, 30' on the fitting or by replacing the appropriate fuel line.

In view of the forgoing it can be seen that by providing a common drain passage from each fuel line fitting within the wall of the engine, any leakage can be routed to a point convenient to the operator for observation.

Other aspects, objects and advantages of this invention can be obtained from the study of the drawings, the disclosure and the appended claims.

I claim:

1. Apparatus for draining liquid from an enging (4), comprising:

a valve cover base (7) having a bore (22) therethrough, a mating surface (68), a common drain channel (66) formed in the mating surface (68), and a drain connecting passage (78) connected between the bore (22) and the common drain channel (66);

a valve cover (11) connected to said mating surface (68) of the valve cover base (7) and defining therewith a common drain passage (64) having a remote drain point (80); and a connector fitting (12) having a drain port (56) therein and being received in said bore (22) such that liquid can be communicated from the drain port (56) to the remote drain point (80) through the drain connecting passage (78) and the common drain channel (66).

2. An apparatus as in claim 1 wherein said connector fitting (12) includes:

an elongate body (24) with a cylindrical sidewall;

two free ends (28,28') each having a connecting chamber (32,32') therein adapted to receive a connector (42) 42';

a central axial passage (36) connecting the two chambers (32,32');

a drain passage (54) connecting at least one connecting chamber (32) to said drain port (56);

two circumferential outer grooves (61) defined in the sidewall of the fitting (12) each adapted to receive an annular seal (60) therein; and a circumferential medial groove (58) disposed axially between said outer grooves (61) and connected to the drain passage (54) by the drain port (56).

3. An apparatus as in claim 2 wherein the drain passage (54) of said connecting fitting (12) is axial, parallel with the central passage (36) and communicates with both connecting chambers (32,32').

4. An apparatus as in claim 2 wherein the drain port (56) is a radial passage oriented perpendicular to the drain passage (54) of said connector fitting (12).

5. An apparatus as in claim 2 further including an annular seal (60) mounted in each of said outer grooves (61) so that said seals (60) engage the bore (22) of the valve cover base (7).

6. An apparatus as in claim 2 further including a fuel line (15,16) connected in each of said connecting chambers (32,32').

7. An apparatus as in claim 1 wherein the drain point (80) is visible to an operator of the engine.

8. An apparatus as in claim 1 including a fuel pump fitting (90) attached to the drain channel (66) at the drain point (80) and connectable to the suction side of a fuel pump (92).

9. An apparatus as in claim 1 wherein said remote drain point (80) is in communication with the atmosphere.

10. An apparatus as in claim 1 wherein said connector fitting (12) is a portion of a high pressure fuel line.

11. An apparatus as in claim 1 wherein said connector fitting (12) includes an elongate body (24) and a pair of annular seals (60, 61) located about said body (24) and individually disposed at either side of said drain port (56).

12. Apparatus for draining liquid from an engine (4), comprising:

a valve cover base (7) for an engine (4), said base (7) having a mating surface (68) thereon;

a plurality of bores (22) through the valve cover base (7), each bore having a sidewall;

a plurality of connector fittings (12) each having a sidewall with a drain port (56) therein and each being received in the respective bores (22);

a valve cover (11) mountable on the valve cover base (7);

an engine drain channel (66) formed by the mating surface (68) of the valve cover base (7) and the valve cover (11), said channel (66) communicating to the atmosphere at a remote drain point (80) when the valve cover (11) is mounted on the valve cover base (7); and a plurality of drain passages (78) in the valve cover base (7) connecting the engine drain channel (66) with the sidewall of each bore (22), said drain passages (78) being adapted for communicating with the drain port (56) in each connector fitting (12) through the sidewall of each bore (22).

13. An apparatus as in claim 1 including a fuel pump fitting (90) attached to the drain channel (66) at the drain point (80) and connectable to a fuel leakage alarm (96).

14. An apparatus as in claim 8 wherein a fuel leakage alarm (96) is connectable to the fuel pump fitting (90).

* * * * *